United States Patent [19]

von Meer

[11] 4,384,040

[45] May 17, 1983

[54] WATERPROOF PHOTOGRAPHIC PAPER

[75] Inventor: Walter von Meer, Bad Iburg, Fed. Rep. of Germany

[73] Assignee: Felix Schoeller, Jr., Fed. Rep. of Germany

[21] Appl. No.: 273,111

[22] Filed: Jun. 12, 1981

[30] Foreign Application Priority Data

Jun. 14, 1980 [DE] Fed. Rep. of Germany ..... 3022451

[51] Int. Cl.[3] ..... G03C 1/76; B05D 3/06

[52] U.S. Cl. ..... 430/532; 430/538; 430/935; 430/942; 427/44; 428/323; 428/481

[58] Field of Search ..... 430/538, 935, 532, 942; 427/44; 428/323, 481; 156/272

[56] References Cited

U.S. PATENT DOCUMENTS

| | | | |
|---|---|---|---|
| 2,875,054 | 2/1959 | Griggs et al. | 430/538 |
| 3,021,214 | 2/1962 | Murphy et al. | 430/536 |
| 3,658,620 | 4/1972 | Hall | 156/272 |
| 3,770,491 | 11/1973 | Spoor et al. | 156/272 |
| 3,963,798 | 6/1976 | Miller | 427/44 |
| 4,057,657 | 11/1977 | Garnett et al. | 427/44 |
| 4,091,050 | 5/1978 | McDonald | 427/44 |
| 4,145,480 | 3/1979 | Kusama et al. | 430/523 |

*Primary Examiner*—Mary F. Downey

*Attorney, Agent, or Firm*—Allegretti, Newitt, Witcoff & McAndrews, Ltd.

[57] ABSTRACT

A waterproof paper support having a photographic emulsion which is coated on both sides with a waterproof synthetic resin. The coating which carries the photographic emulsion preferably is a prepolymer of an unsaturated polyester resin which can be polymerized by electron bombardment. This coating contains at least 20% by weight of a white light-reflecting pigment having a particle size in excess of 0.1 micron.

12 Claims, No Drawings

WATERPROOF PHOTOGRAPHIC PAPER

This invention relates to a photographic paper, more particularly a waterproof coated paper support for photographic purposes.

PRIOR ART

Waterproof photographic papers consist, according to German Pat. No. 1,447,815, of a paper support, with synthetic resin films extruded onto both faces and one or more photosensitive coatings containing silver salt on one of the synthetic resin surfaces. The photosensitive coatings may involve black-and-white or color photographic coatings. The synthetic resin layer disposed beneath the photographic coatings usually contains light-reflecting white pigment, for example titanium dioxide, and also possibly shading dyes (graduating dyes) and/or optical brighteners. The content of white pigment usually amounts to 8 to 15% of the synthetic resin, which preferably is polyethylene.

Other waterproof photographic support papers have already been described earlier (e.g., Canadian Pat. No. 476,691). These consist of a paper support, which consists on one side of a pigment coating based upon barium sulphate and of a pigment-free synthetic resin coating disposed thereupon. Also, papers coated with pigment-containing lacquers have long been known as waterproof supports for photographic coatings (German Pat. No. 912,173).

A disadvantage of polyolefin-coated papers according to German Pat. No. 1,447,815 is the unsatisfactory image sharpness in many cases of the photographic images made with such papers. The reason for this is that, with the relatively low content of white pigment (maximum 15%), only a small portion of the light incident at exposure is reflected just at the surface of the polyolefin coating. A larger portion of the light is scattered at the pigment particles further from the surface and produces, due to displaced secondary exposure, lack of definition in the supported photographic image. Polyolefins with significantly higher pigment concentrations will not adhere satisfactorily to the paper. A further disadvantage of papers according to this disclosure is the sensitivity to scratching of the polyolefin surfaces.

Papers which, according to Canadian Pat. No. 476,691, carry a conventional barytes coating (85–90% $BaSO_4$ as white pigment) with a pigment-free synthetic resin layer disposed thereon, do not give satisfactorily sharp photographic images. Incident light is indeed reflected predominantly at the surface of the bartyes coating due to the dense packing of the pigment particles, but on account of the distance between the reflecting surface and the photographic coating resulting from the pigment-free synthetic resin layer, lack of definition occurs.

Papers coated according to German Pat. No. 912,173 with a pigmented lacquer coating having a pigment content of approximately 24% do give a clearly higher image definition. As is always the case when volatile organic solvents are used, they suffer many disadvantages. A particular disadvantage is found to be that the residual moisture content of the paper evaporates with the volatile organic lacquer solvents during hot air drying of the coating. Consequently, lacquered papers have a tendency during further processing to unusually pronounced electrostatic charging. The usual incorporation (according to German Pat. No. 1,422,865) of electrolytes into the base paper to prevent electrostatic charging has proved to be ineffective in this case, because the action of the electrolytes is based substantially upon the residual moisture in the paper. Further disadvantages of this excessive drying out of lacquered papers are an uncontrollable curving behavior and non-uniform hardening of the applied photographic coatings, because both the hardening of the photographic coatings and the curving behavior of the finished photographic papers are substantially influenced by the moisture content of the support.

On account of the described specific disadvantages of the known waterproof photographic paper substrates, conventional papers coated with barium sulphate pigment layers are still always used as photographic supports when high definition is desired. It is, however, also known that these papers, since they are not waterproof, require a high degree of washing and drying in order to remove firstly the residue of the photographic processing baths and then the absorbed water.

THE INVENTION

The object of the present invention consequently is to create a waterproof photographic paper support material, which overcomes the disadvantages of the known waterproof coated paper supports. In particular it is an object of the present invention to provide a paper support material protected by a waterproof, highly-pigmented coating, which is suitable for the production of photographic images of high definition and which is prepared in such manner that the set residual moisture of the base paper is fully retained. A further object is that the support material contain no chemicals which generate in the photographic layers a haze such as may be expected, for example, where polymerization initiators, catalysts and other substances containing chemically reactive groups are used. These objects are achieved by coating one side of a photographic base paper with an organic unsaturated polymerizable resin which hardens under bombardment by electrons, and the mineral white pigment content of which is 20–70% by weight. Such resins and the method of curing them are known; see, for example, U.S. Pat. No. 3,658,620. The preferred resins there described are condensation products of unsaturated organic polybasic acids and polyhydric alcohols.

In one simple embodiment, a vinyl monomer, for example hexane diol diacrylate, is mixed with the white pigment, e.g. $BaSO_4$, and the mixture is coated onto a paper surface for example by means of a wiper rod. The polymerization is then initiated by accelerated electron beams under a protective gas (e.g. nitrogen) to keep the surface of the coating oxygen free. The surface obtained is white, hard, waterproof, free from pores and has a high reflection density. The moisture content of the coated paper is not changed by the coating process or the hardening of the coating, and no harmful reactive chemicals are required for initating the polymerization.

Essentially, any radiation-polymerizable compounds having C=C double bonds are suitable for the production of the pigment coatings of this invention. In order to obtain a mar-resistant surface which is also flexible, it is of advantage to use mixtures of unsaturated polyester resins and a reactive olefinic unsaturated compound such as vinyl monomers, so as to make possible a controlled cross-linking during polymerization. Mixtures that have proved suitable in respect of mar-resistance and flexibility are hardened mixtures containing polyunsaturated prepolymers or low-molecular resins and poly-unsaturated monomers. It is possible to use alone multifunctional, (di-, tri-, tetra-, etc.) with monofunctional monomers as well as mixtures of other resins with multifunctional monomers. Multifunctional monomers used alone produce coatings that are too brittle.

The polymerization hardening of the resin is carried out in the absence of air by bombarding the surface with electrons from a cathode ray tube or similar generator. The energy level is approximately 50 joules/g (2.4 cal/g) at a distance of 20 to 100 mm from the surface. A suitable apparatus is sold under the mark ELECTROCURTAIN by Energy Science, Inc. of Burlington, Mass. and has an output of 200 KV to 500 KV at 100 milliamperes. The output of the generator must be increased with the distance from the surface being polymerized.

Suitable commercially obtainable resins and prepolymers containing at least two C=C double bonds per molecule and having a molecular weight between 500 and 5000, and which can be hardened by radiation are:

acrylic esters of aliphatic polyurethanes
acrylic esters of terephthalic acid-diol (or-polyol-) polyesters
acrylic esters of methylol melamine resins
maleic acid diol polyester
acrylic esters of bisphenol A epoxy resins
unsaturated polyester resins
styrene-butadiene copolymer resins
acrylic acid esters of hydrolyzed starch or hydrolyzed cellulose
fumaric acid diol polyester.

Suitable compounds that can be hardened by accelerated electron rays are:

acrylic acid esters and methacrylic acid esters of mono- or polyhydric alcohols (e.g. hexane diol diacrylate, hydroxy ethyl methacrylate or others)
acrylic acid esters and methacrylic acid esters of mono- or dihydric ether alcohols
mono-, di-, tri-, tetra- pentaacrylates of polyhydric alcohols (e.g. trimethylol propane triacrylate, neopentyl glycol di-(meth) acrylate, pentaerythritol triacrylate or others)
cyanoethyl acrylate
glycidyl (meth) acrylate
allyl acrylate
cyclohexyl methacrylate
diallyl fumarate
divinylbenzene.

In principle, of course, any other vinyl compound may be used which is not volatile under processing conditions.

Non-hardening resins suitable for admixing with unsaturated substances have an average molecular weight of 1000–7000. They may be used to modify the processing characteristics of the reactive resin. They are preferably from one of the following:

cellulose ester
polyvinylbutyral
polyvinyl acetate and vinyl acetate copolymers
saturated and unsaturated styrene-free polyester resins
styrene/acrylate resins
polystyrene resins.

White pigments and fillers suitable for the production of pigmented mixtures of this invention are:

barium sulphate
titanium dioxide (rutile and anatase)
zinc sulphide
calcium carbonate
magnesium oxide
metal silicates (e.g. aluminium silicate)
aluminium hydroxide and oxide
various mixed oxides of titanium (e.g. magnesium titantate)
titanium phosphate
satin white
silicon dioxide
zinc oxide.

The average particle size of the light-scattering or reflecting pigments used in mixtures according to this invention exceeds 0.1 μm (preferably greater than 0.5 μm). Particle sizes less than 0.1 μm diameter do not result in the desired improved definition performance. Although the specific white pigment is not critical, barium sulphate and titanium dixoide are preferred.

Additions of blue, violet and red shading dyes to white pigmented mixtures may be made to enhance the subjective impression of whiteness. The dyes may be added to compensate for a yellowish tint of the resin layer or any off-white tint of the photographic coatings. Inorganic color pigments are commonly used, e.g. ultramarine, cobalt blue, cobalt violet, cadmium red and other, but organic pigments may also be used (e.g. phthalocyanine pigments). There is no lower limit to the size of the color or black pigment particles.

For special applications, larger quantities of more intensitively coloring pigments may be mixed in, for example as antihalo agents. Coated papers used especially in silver salt diffusion transfer processes contain carbon black or fine particled graphite in the waterproof resin coating. In this case also, no lower particle size limit need be observed.

The paper substrate to be coated may be any photographic base paper which is either neutrally sized on a base of alkyl ketene dimer or has a known acid sizing on a base of precipitated resin soaps, fatty acid soaps or fatty acid anhydrides. The papers also preferably have a sealing surface sizing of water-soluble or water-dispersible binder. The surface sizing may contain pigments and/or antistatically active additives; also water-repellent or coloring additives. The base paper may have a weight of 60–250 g/m$^2$ (preferably 80–200 g/m$^2$) and may be smooth or rough. It can be made exclusively from cellulose fibers or from mixtures of cellulose fibers with synthetic fibers.

In the following examples the principles of this invention are explained in more detail, and the superiority of the paper supports produced according to this invention is attested by the comparative testing of the paper supports produced according to the examples and paper supports produced according to the state of the art (comparative examples).

SPECIFIC EXAMPLES

Example 1

A photographic base paper neutrally sized by using alkyl ketene dimer and having a surface sizing consisting of starch and sodium sulphate, with a surface weight of approximately 160 g/m$^2$, was coated on one side with a pigmented, hardenable mixture. The composition of the coating mixture was:

25% by wt. polyester acrylate* (MW=approx. 1000, 4 double bonds per molecule)
25% by wt. hexane diol diacrylate 15% by wt. trimethylol propane triacrylate
35% by wt. titanium dioxide, rutile (average particle diameter=approx. 0.2 μm, surface-treated).

*Sold as Ebecryl 970 by UCB S.A., Drogenbas, Belgium.

The diacrylate and triaacrylate monomers reduce the viscosity of this heavily loaded compound so as to permit coating the paper by means of a cylinder rotating in a resin bath. The quantity of coating applied was approximately 40 g/m². The coating was then hardened under nitrogen with accelerated electrons, using an energy dose of 50 J/g.

Example 2

On one side of an approximately 160 g/m² photographic base paper, approximately 40 g/m² of the following mixture was coated and hardened by electron rays with an energy dose of 50 J/g. The composition of the coating mixture was:

18% by wt. aliphatic polyurethane acrylate (Ebecryl 270) (MW=approx. 4000, with 2 double bonds per Mol)
30% by wt. hexane diol diacrylate
4% by wt. 2-hydroxy ethyl acrylate
3% by wt. ethylcellulose (48% ethoxyl content, degree of viscosity 50 MPas at 25° C., 5%)
45% by wt. titanium dioxide, rutile (mean particle diameter=0.2 μm, surface-treated).

Example 3

On one side of an approximately 160 g/m² photographic base paper approximately 35 g/m² of the following mixture was coated and hardened by electron rays with an energy dose of 40 J/g. The composition of the coating mixture was:

15% by wt. polyester acrylate (MW=approx. 1000, with 4 double bonds per molecule) (Ebecryl 810)
39% by wt. hexane diol diacrylate
45% by wt. titanium dioxide, rutile (average particle diameter=0.2 μm, surface-treated).

Example 4

An approximately 130 g/m² photographic base paper was coated on one side with approximately 26 g/m² of a hardenable mixture, which was hardened by electron rays with an energy dose of 50 J/g.

The composition of the coating mixture was:

35% by wt. polyester acrylate (MW=approx. 1000, with 4 double bonds per molecule) (Ebecryl 810)
40% by wt. hexane diol diacrylate
25% by wt. titanium dioxide, rutile (mean particle diameter=0.3 μm, surface-treated).

Example 5

On one side of an approximatley 180 g/m² photographic base paper, approximately 30 g/m² of a hardenable mixture was coated, which was hardened by electron rays with an energy dose of 50 J/g. The composition of the coating mixture was:

25% by wt. aliphatic polyurethane acrylate (MW=approx. 5000, with 6 double bonds per molecule) (Uvithane 783, Thiokol Corp., Trenton, N.J.)
17% by wt. trimethylol propane triacrylate
17% by wt. diethylene glycol diacrylate
30% by wt. titanium dioxide, rutile (mean particle diameter=0.2 μm, surface-treated)
10% by wt. aluminium oxide, calcined (mean particle diameter=2 μm)
1% by wt. alkylol amine salt of polyacrylic acid.

Example 6

One side of an approximately 160 g/m² photographic base paper was coated with approximately 35 g/m² of a hardenable mixture, which was hardened by electron rays with an energy dose of 50 J/g. The composition of the coating mixture was:

20% by wt. epoxy acrylate (MW=approx. 1500, with 4 double bonds per mol.) (Synocure 3100, Cray Valley Products Ltd., Orpington, England)
15% by wt. butane diol diacrylate
10% by wt. polyethylene glycol-(400)-diacrylate
4% by wt. phthalic acid polyester plasticizer (Weichmacher CEL, Bayer A. G., Leverkusen, Germany)
1% by wt. ethoxylated nonyl phenol
30% by wt. titanium dioxide, anatase (mean particle diameter=0.25 μm, surface-treated)
20% by wt. calcium carbonate (mean particle diameter=3 μm, surface-treated with calcium resinate).

Example 7

One side of an approximately 160 g/m² photographic base paper was coated with approximately 35 g/m² of the following mixture and hardened by electron radiation with an energy dose of 50 J/g. The composition of the coating mixture was:

17.5% by wt. fumaric acid/hexane diol polyester (MW=approx. 2000)
25.5% by wt. pentaerythritol triacrylate
10% by wt. ethoxy ethoxy ethyl acrylate
2% by wt. styrene/ethyl acrylate copolymer (MW=5000, monomer ratio 1:3)
35% by wt. barium sulphate (mean particle diameter =0.5 μm)
10% by wt. titanium dioxide, anatase (mean particle diameter=0.25 μm).

All the papers coated on one side in accordance with Examples 1 to 7 were coated on the uncoated side of the paper with an antistatic coating suitable for writing upon. This coating was produced, like that applied first on the front face, from a hardenable mixture and was hardened by electron rays with an energy dose of 50 J/g. The composition of the mixture was:

35% by wt. polyester acrylate (MW=approx. 1000, with 4 double bonds per mol.) (Ebecryl 810)
35% by wt. hexane diol diacrylate
20% by wt. titanium dioxide, rutile (mean particle diameter=0.3 μm)
8% by wt. micronized silicic acid (mean particle diameter=4 μm)
5% by wt. butyl ester of phosphoric acid (approximately equal parts of monobutyl phosphate and dibutyl phosphate).

The quantity of coating applied corresponded in all the examples approximately to that applied on the front face in g/m².

Essentially, the rear side may be coated with any composition, provided that at least the water resistance and the planeness of the paper are thereby assured. The model mixture stated here was selected because it complies not only with the stated properties but also satisfied some other requirements of photographic papers. A coating produced from it, after hardening, is not only waterproof but also white, suitable for writing upon and antistatic.

Following the coating of the rear face, in all the papers of Examples 1 to 7 the initially applied, pigmented front side coating was subjected in known manner to a corona treatment to facilitate adhesion and coated with a solution of the following composition:

5% by wt. gelatine
0.4% by wt. phenol
0.5% by wt. of 5% saponin solution
84.1% by wt. desalinated water
5% by wt. isopropanol
5% by wt. butanol
Ammonia solution up to pH=8.4.

After the coating has dried, a thin layer of approximately 0.7 g/m$^2$ remains, which serves as a bonding promotion layer for photographic coatings to be applied later.

Reference Example A

Following the teaching of Example 4 of German Pat. No. 1,447,815, an approximately 160 g/m$^2$ photographic base paper was coated on the front face by means of extrusion coating with a film of low-density polyethylene (d=0.924 g/cm$^3$) containing 15% by wt. titanium dioxide.

The weight per unit area of the polyethylene/-titanium dioxide coating was approximately 38 g/m$^2$. The free film surface was then subjected to an electrical discharge treatment (corona treatment) and thus prepared for accepting a photographic emulsion coating.

The rear face of the thus-coated paper was coated with approximately 38 g/m$^2$ high-density polyethylene (d=0.963 g/cm$^3$).

Reference Example B

An approximately 190 g/m$^2$ photographic base paper was coated on one face with a conventionally known coating of barium sulphate and gelatin. The weight of coating was approximately 40 g/m$^2$.

Reference Example C

Photographic paper according to Reference Example B was coated on both sides according to Canadian Pat. No. 476,691 with a film of approximately 25 g/m$^2$ cellulose acetobutyrate and then coated with a cellulose nitrate gelatin bonding coating.

Testing of the Photographic Papers

In order to prepare a comparative test of the image definition of the photographic images produced on the different papers, the papers of Examples 1–7 and of Reference Examples A–C were each covered on the already pigmented coated front face with a conventional finely particulate black-and-white silver halide emulsion coating of high resolution capability. The thus obtained photographic materials were exposed in the usual way to an image through a test negative, were developed and fixed. The test negative used was a linear grating produced in the form of a progress wedge.

Since photographic papers having different reflective characteristics exhibit a different graph of the optical density over theprogress wedge, the copied line grating enables a measurable variable to be obtained over the progress wedge, which makes possible a reproducible comparative statement about the sharpness performance of the various specimens.

By this method ratio coefficients were established, using as a basis the definition measurement coefficient 100 for Reference Example B (conventional barytic paper), which was chosen as the reference paper.

The following results were obtained:

| | Definition Measurement Coefficient |
|---|---|
| Example 1 | 97 |
| Example 2 | 100 |
| Example 3 | 100 |
| Example 4 | 90 |
| Example 5 | 95 |
| Example 6 | 97 |
| Example 7 | 94 |
| Reference Example A | 70 |
| Reference Example B | 100 |
| Reference Example C | 75 |

In further testing it was established that the moisture content of the sheets according to Examples 1–7 and of Reference Example A after coating as previously was equal to the equilibrium moisture that became established at 50% relative humidity (r.h.), whereas Reference Example C exhibited a moisture content which was equal to an equilibrium moisture of 20% r.h. The conventionally lacquered Reference Example C was completely dried hard.

An empirical establishment carried out at 50% r.h. of the electrostatic charging exhibited when the test sheets were brought into contact and then separated gave the following results:

| | |
|---|---|
| Example 1 | no electrostatic charging |
| Example 2 | no electrostatic charging |
| Example 3 | no electrostatic charging |
| Example 4 | no electrostatic charging |
| Example 5 | no electrostatic charging |
| Example 6 | no electrostatic charging |
| Example 7 | no electrostatic charging |
| Reference Example A | light electrostatic charging |
| Reference Example B | no electrostatic charging |
| Reference Example C | moderately strong electrostatic charging. |

Sensitometric tests gave in all the examples according to this invention, as in the reference examples, approximately equal characteristics in respect of sensitivity, contrast, photographic density and fogging tendency after incubation.

A testing of planeness at various conditions of the atmosphere (25%, 50% and 80% r.h.) gave the least tendency to curling with the Examples of this invention 1–7, whereas the Reference Example B and C under the same conditions exhibited the greatest tendency to curl. Reference Example A was only slightly worse than the paper specimens prepared according to this invention.

In respect of waterproofness, Examples 1–7 corresponded completely to the corresponding papers coated with polyethylene (e.g. Reference Example A), i.e. photographic materials made with them required, in conventional mechanical development, equal times up to the discharge of the dried pictures.

In summary, the photographic papers manufactured according to this invention are clearly superior to the polyethylene-coated papers (Reference Example A) in respect of image definition, whereas they are comparable to them in all other characteristics. On the other hand, the photographic papers made according to this invention are equivalent in respect of definition to the conventional barytic papers and, by contrast to the latter, at the same time satisfy all the requirements in respect of waterproofness and planeness.

I claim:

1. A paper support for a photographic emulsion of light sensitive silver salts used in making black and white or color photographic prints, said paper support characterized by a high degree of waterproofness, planeness, image definition, and sufficient residual moisture to prevent pronounced electrostatic charge and comprising paper coated on all sides with a waterproof synthetic resin, the coating on at least one side being the electron-radiation-hardened prepolymer product of organic unsaturated polyester and reactive olefinic resins free of solvents and chemical catalysts and containing more than about 20% by weight of a white light-reflecting pigment having a particle size in excess of about 0.1 micron, whereby the characteristics of the paper support are formed through polymerization of the resins without exposing the paper to heat.

2. The support of claim 1 in which the quantity of said pigment ranges from 30% to 70%.

3. The support of claim 1 in which the resin coating on the other side of the paper contains a black, light-absorbing pigment.

4. The support of claim 1 in which said polyester coating also contains shading dyes to compensate for a yellowish tint of said coating.

5. The support of claim 1 in which said polyester prepolymer has a molecular weight of between 500 and 5000 and at least two double bonds per molecule.

6. The support of claim 5 in which said polyester is an acrylic acid ester.

7. The support of claim 1 in which said polyester resin also contains a non-hardening resin having an average molecular weight of 1000 to 7000.

8. The support of claim 1 in which said prepolymer is a mixture of a polyester acrylate and hexane diol diacrylate and is applied to both sides of said paper.

9. A photographic paper characterized by high image definition, planeness and controlled moisture content comprising the paper support of claim 1 having light-sensitive photographic emulsion overlying said pigmented polyester coating.

10. The paper support of claim 1 wherein said coating additionally contains plasticizers.

11. A method of making a paper support for a photographic emulsion of light sensitive silver salts used in making black and white or color photographic prints, said paper support characterized by a high degree of waterproofness, planeness, image definition, and sufficient residual moisture to prevent pronounced electrostatic charge, said method comprising in combination;

(a) coating all sides of a paper with a liquid mixture which includes (1) organic unsaturated polyester and reactive olefinic resins free of solvents and chemical catalysts and (2) more than about 20% by weight of a white light-reflecting pigment having a particle size in excess of about 0.1 micron; and (b) hardening the coating on the paper by exposing the coating to electron radiation, whereby the characteristics of the paper support are formed through polymerization of the resins without exposing the paper to heat.

12. The method of claim 11 in which the exposure to electron radiation occurs under anerobic conditions.

* * * * *